US006408447B1

(12) United States Patent
Burbank et al.

(10) Patent No.: US 6,408,447 B1
(45) Date of Patent: Jun. 25, 2002

(54) ADULT URINE SPLASH GUARD

(76) Inventors: Roderick S. Burbank, 19310 Marlowe, Detroit, MI (US) 48235; Tim Hill, 28250 Santa Barbara, Lathrup Village, MI (US) 48076

( * ) Notice: Subject to any disclaimer, the term of this patent is extended or adjusted under 35 U.S.C. 154(b) by 0 days.

(21) Appl. No.: 09/518,315

(22) Filed: Mar. 3, 2000

Related U.S. Application Data

(60) Provisional application No. 60/122,641, filed on Mar. 3, 1999.

(51) Int. Cl.[7] ..... E03D 9/00
(52) U.S. Cl. ..... 4/300.3; 4/DIG. 5
(58) Field of Search ..... 4/237, 239, 300.3, 4/457, DIG. 5

(56) References Cited

U.S. PATENT DOCUMENTS

| | | | | | |
|---|---|---|---|---|---|
| 2,709,816 A | * | 6/1955 | Lamb | 4/239 |
| 4,516,279 A | | 5/1985 | Block | 4/235 |
| 4,716,602 A | | 1/1988 | Brickhouse | 4/237 |
| 5,161,263 A | | 11/1992 | Geneve et al. | 4/483 |
| 5,182,818 A | | 2/1993 | Nawoj | 4/235 |
| 5,669,081 A | * | 9/1997 | Scherer et al. | 4/253 |

* cited by examiner

*Primary Examiner*—Robert M. Fetsuga
(74) *Attorney, Agent, or Firm*—Gifford, Krass, Groh, Sprinkle, Anderson & Citkowski, P.C.

(57) ABSTRACT

A urine deflector is designed to be detachably interconnected with a toilet seat of the type having an upper surface designed to support a user and a hole defined through the seat. The deflector includes a stream deflection member designed to deflect a stream of urine into the toilet bowl. The deflection member has a concave deflection surface. A support member is provided that has a generally planar body designed to be supported on the upper surface of the toilet seat. The generally planar body supports the deflection member such that when the generally planar body is placed on the upper surface of the toilet seat, the deflection member projects into the hole in the seat and the concave deflection surface faces a user seated on the seat. The support member also includes an attachment for releasably retaining the generally planar body in engagement with the upper surface of the seat.

19 Claims, 9 Drawing Sheets

ADULT URINE SPLASH GUARD

CROSS-REFERENCE TO RELATED APPLICATIONS

This application claims the benefit of United States Provisional Application having Serial Number 60/122,641 filed Mar. 3, 1999.

FIELD OF THE INVENTION

The present invention relates generally to urine splash guards and, more specifically, to a urine deflector designed for use by adults and that may be detachably interconnected with a variety of toilet seat configurations.

BACKGROUND OF THE INVENTION

Physically challenged adults and the persons who care for them often find using a toilet to be one of the most difficult tasks. One problem associated with toilet use is that urine may be directed outside of the toilet bowl by a male user who is not able to lean forward or otherwise direct the flow of urine while sitting on a toilet seat. Often, when a male user is sitting on a toilet in an upright position, as if sitting in a normal chair, his urine may be directed horizontally towards the front of the toilet. Urine may then pass over the top of the toilet bowl, between the toilet bowl and toilet seat, over the toilet seat, or may impinge on the toilet seat or upper edge of the bowl. Obviously, any of these conditions creates an undesirable mess in the toilet area as well as potentially splashing urine onto the patient and his helper. This problem is magnified by the use of some handicapped type toilet seat adapters wherein the toilet seat is raised several inches above the existing bowl. These adapters are designed to make it easier for a wheelchair bound patient to move on and off of the toilet seat. However, by raising the seating surface, the likelihood that a stream of urine may pass over the top of the toilet bowl is increased. In light of the above problems, there is a need for a toilet accessory that will redirect a stream of urine into the toilet bowl, thereby reducing contamination of the toilet, toilet area, patient, and any helpers. There have been a number of attempts to solve the above-enumerated problems. However, each of the "solutions" has fallen short.

Many people are familiar with toilet training seats designed for infants first learning the use the toilet. These seats are sized and shaped for an infant user and often have a built-in urine deflector mounted to the front edge of the plastic seat. Obviously, these devices are not designed or suitable for adult users. Also, the urine deflector portion is typically permanently attached to the remainder of the training seat. On those designs wherein the urine deflector is detachable, the urine deflector only works with that specific seat and is not suited for use with other designs of seats. For example, U.S. Pat. No. 5,161,263 to Geneve et al. discloses a training toilet that provides for the use of an optional urine deflector. The urine deflector may be detached from the remainder of the apparatus but requires the provision of a specially shaped engagement slot for interconnecting the deflector with the remainder of the device. Therefore, the deflector is not suitable for use with other types of devices.

U.S. Pat. No. 4,516,279 to Block discloses another design for a child's toilet trainer. This device is a flat piece of material which, in a use position, rests atop the toilet seat and provides a smaller opening suitable for an infant user. In a non-use position, the trainer device can be stored flush against s the lid of the toilet. The toilet trainer includes a flip-up urine deflector to prevent urine from passing over the top of the trainer. However, this design also fails to provide a urine deflector which may be used with other types of seats.

U.S. Pat. No. 4,716,602 to Brickhouse provides a urine deflector designed to be used by adult users and which is interconnectable with a standard toilet seat. The deflector is formed from a sheet of flexible plastic which may be folded so as to form the deflector. The deflector then interconnects with the toilet seat using hook and loop fasteners. This device is better suited to adult users, but still has several shortcomings. First, the deflector is not shaped so as to avoid splash back and therefore may contribute to a mess. Also, the way in which the deflector attaches to the toilet seat is inconvenient. Specifically, will an adult user, it is preferable to attach the deflector to the seat after the user is already placed on the seat. In this way, injury is less likely as the user is slid onto the seat. If a deflector is first attached to the toilet seat, prior to placing the user on the seat, parts of the user's body may contact the deflector as they attempt to move their body onto the seat. The Brickhouse design would be very difficult to attach to the toilet seat after a user is already seated on the seat. Also, the Brickhouse design appears to only work with standard toilet seat designs and would not work well with thicker toilet adapters designed for handicapped users. Finally, it appears that the Brickhouse device would not be securely held in position during use, and therefore may not function reliably.

U.S. Pat. No. 5,182,818 to Nawoj discloses a child training seat adaptor for use with a full-sized toilet seat. This design suffers from shortcomings similar to those associated with the Geneve et al. and Block patents. Specifically, the urine deflector is detachable but requires specific attachment provisions for interconnecting the deflector with the remainder of the device. Therefore, the device is unsuitable for use with other types and sizes of seats.

In light of the above, there remains a need for an improved urine deflector that may be used with a variety of toilet seat designs and, preferably, allows attachment of the deflector after the user is seated on the toilet seat.

DETAILED DESCRIPTION OF THE PREFERRED EMBODIMENTS

Figure 1:
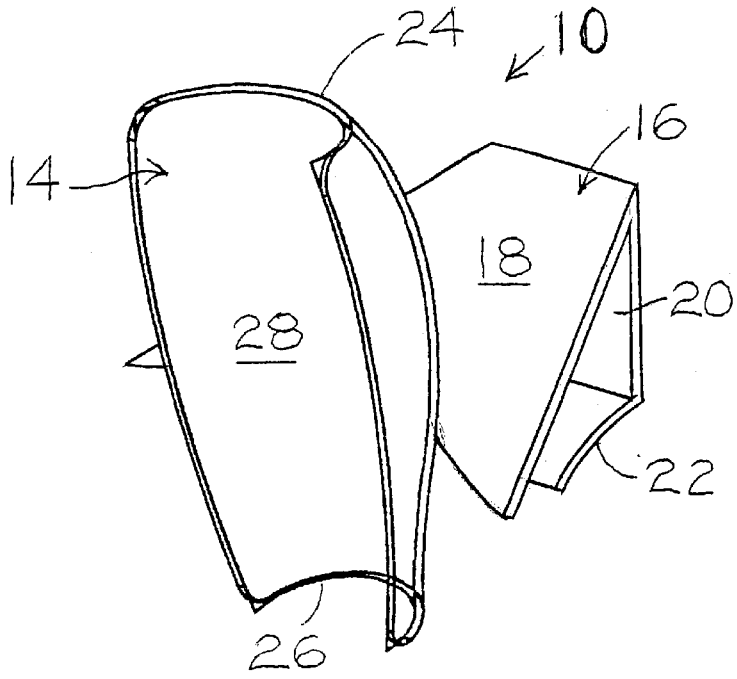
FIG. 1 is a perspective view of an adult urine deflector according to the present invention.
Figure 2:
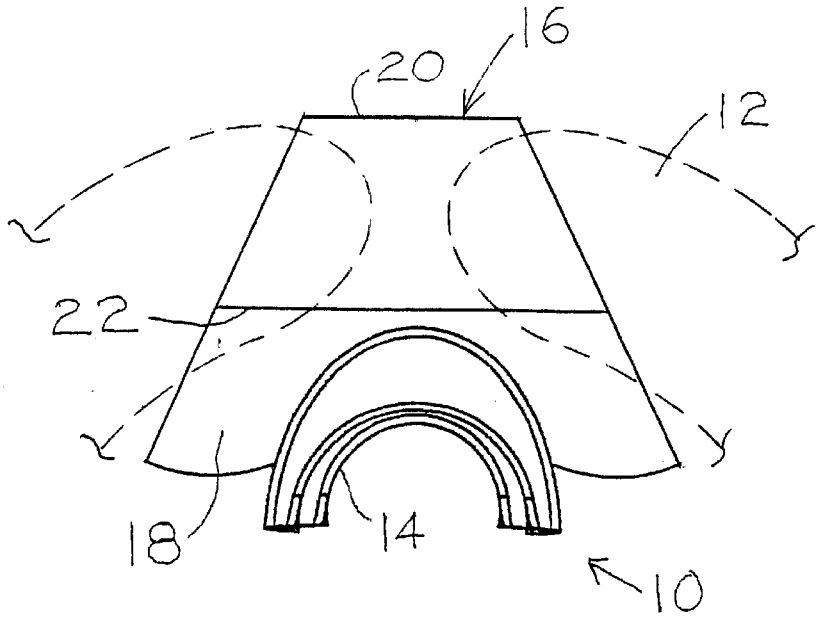
FIG. 2 is a top view of the deflector of FIG. 1 shown installed on one type of toilet seat.
Figure 3:
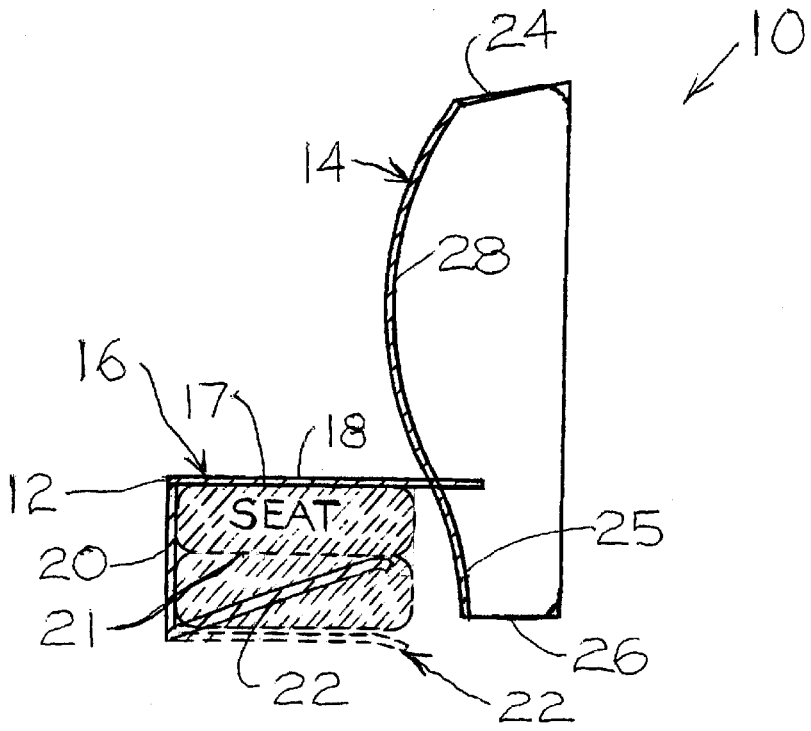
FIG. 3 is a cross-sectional side view of the deflector of FIG. 1 shown attached to a toilet seat.
Figure 4:
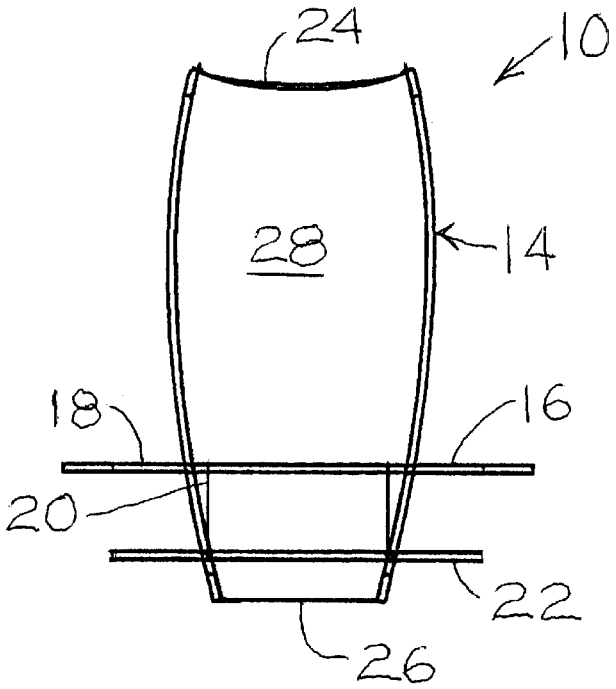
FIG. 4 is a front view of the deflector of FIG. 1.

Referring now to FIGS. 1–4, an adult urine deflector according to the present invention is generally shown at 10. The deflector 10 is designed to clip to a variety of toilet seat configurations. In some of the Figures, a toilet scat is shown generally as 12. The deflector 10 includes a shaped deflection member 14 and a toilet seat engaging clip 16. The clip 16 includes a top generally planar portion 18 which is generally horizontal when the deflector 10 is in die use position on a toilet seat 12. The clip 16 also includes a back portion 20 which extends perpendicularly downwardly from the rearmost edge of the top portion 18. A lower lip 22 extends generally forwardly from the lowest edge of the back portion 20. Together the top portion 18, tie back portion 20 and the lip 22 have a generally U-shaped configuration in cross-section, as best shown in FIG. 3. The space inside of the U-shaped cross-section is designed to accept a front portion of a toilet seat 12. The toilet seat 12 has an upper surface 17 and a lower surface 21. The planar portion 18 of the clip 16 is supported on upper surface 17 and the lower lip 22 engages the lower surface 21. As shown in FIG. 3, the lower lip 22 is flexible so that the clip 16 may accommodate a variety of toilet seat thicknesses. The clip 16 is shown in solid lines gripping a thin toilet seat 12 and in dotted outline shown gripping a thicker toilet seat 12. The lower lip 22 cooperates with the back portion 20 and upper portion 18 to securely grip the toilet seat 12.

The shaped deflection member 14 is connected to the forward edge of the top portion 18 of the clip 16. As shown, the deflection member 14 extends generally vertically with an upper end 24 positioned well above the top of a toilet seat 12 when the deflector 10 is secured to the toilet seat 12. The lower edge 26 of the deflection member 14 is designed to extend below, or at least even with the bottom of a toilet seat 12. The bottom portion of the deflection member below the planar portion 18 may be referred to as a downwardly extending skirt 25. In some embodiments, the skirt 25 extends below the lower surface 21 of the toilet seat 12 when attached thereto. The deflection member 14 has a concave inner deflection surface 28 extending between the upper 24 and lower 26 edges. This deflection surface 28 is shaped so as to direct urine which impinges upon the surface 28 downwardly into the toilet. In this way, if urine is directed above the toilet bowl, the urine will encounter the deflection member 14 and be directed downwardly into the toilet bowl. As shown, the deflection member is preferably a one piece design.

As shown in the various figures, the inner deflection surface 28 of the deflection member 14 is preferably convexly shaped so as to assist in the efficient deflection of urine into a toilet. Specifically, the deflection surface is concave both side-to-side and top-to-bottom. That is, if a horizontal cross-section is taken through the deflection surface 28, the cross-section will be concave. Likewise, if a vertical cross-section is taken through the deflection surface 28, as shown in FIG. 3, this cross-section is also concave. Therefore, the inner surface 28 may be said to be both horizontally and vertically concave. This three-dimensional concavity assists in the efficient deflection of urine downwardly into the toilet. As can also been seen in FIG. 3, the inner surface 28 is also smoothly curved without any discontinuities to allow the unimpeded flow of liquid continuously down the inner surface to the lower edge.

Referring now to FIG. 2, one configuration of toilet seat 12 is shown. As shown, some toilet seats 12 have an open space at their front edge. Other toilet seats are closed at the front edge. The clip 16 of the deflector 10 is designed to work with either type of toilet seat. As shown in FIG. 2, the clip 16 is sufficiently wide to grip the ends of the toilet seat 12 on each side of the front opening. Alternatively, the clip 16 will grip a closed front toilet seat.

Figure 5:
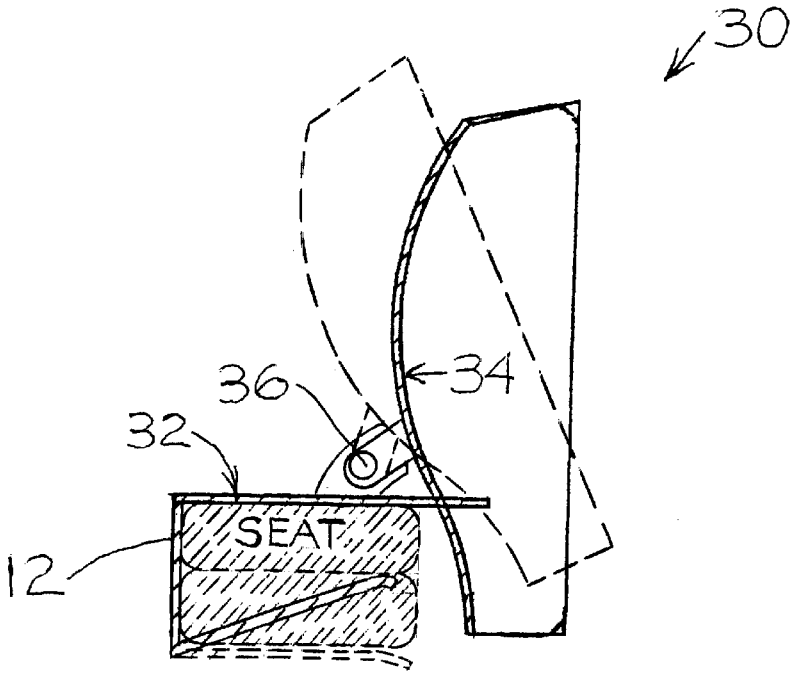
FIG. 5 is a cross-sectional side view of a first alternative embodiment of an adult urine deflector according to the present invention.
Figure 6:
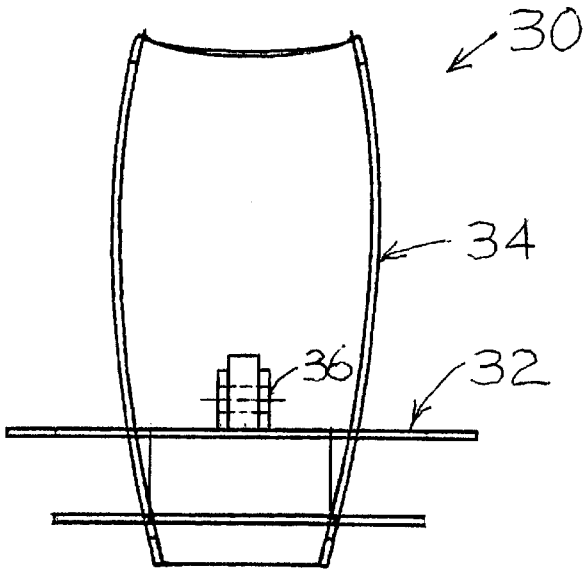
FIG. 6 is a front view of the deflector of FIG. 5.
Figure 7:
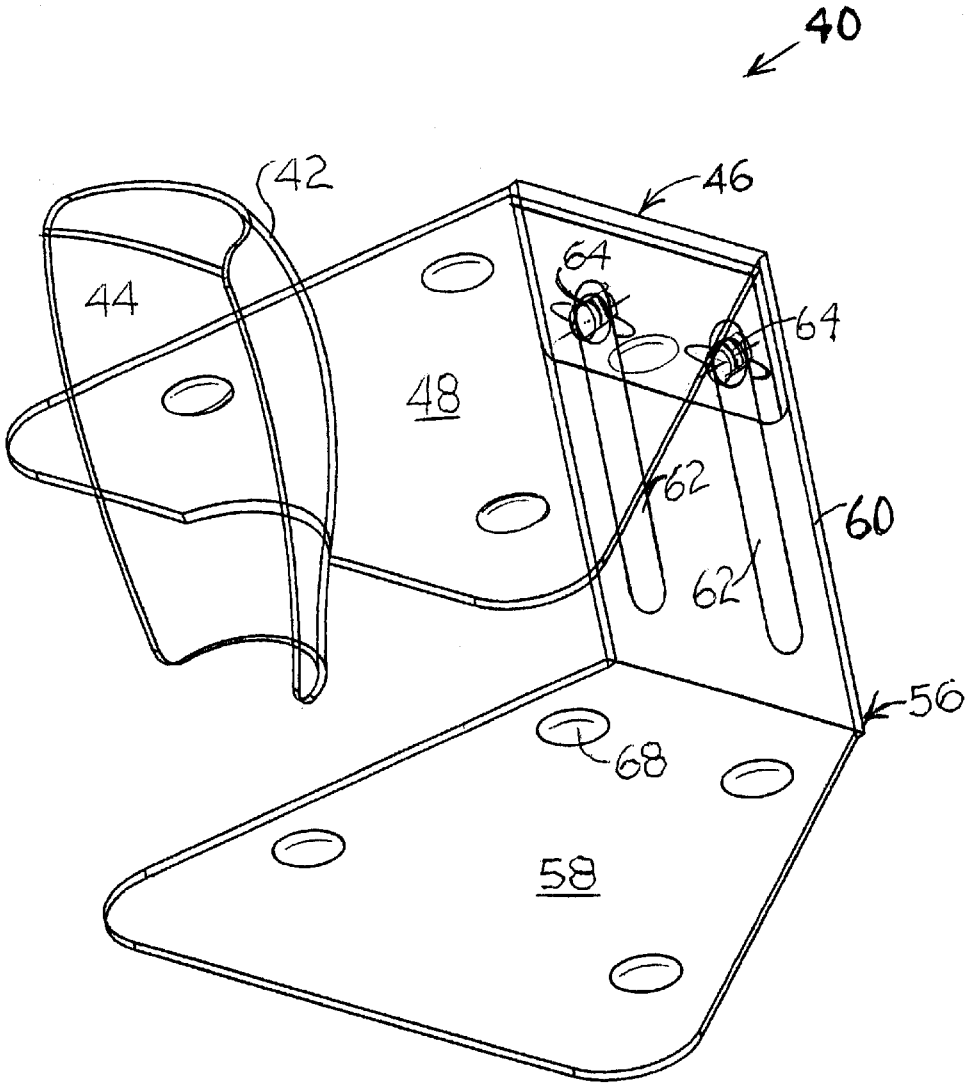
FIG. 7 is a perspective view of a third embodiment of a urine deflector according to the present invention.
Figure 9:
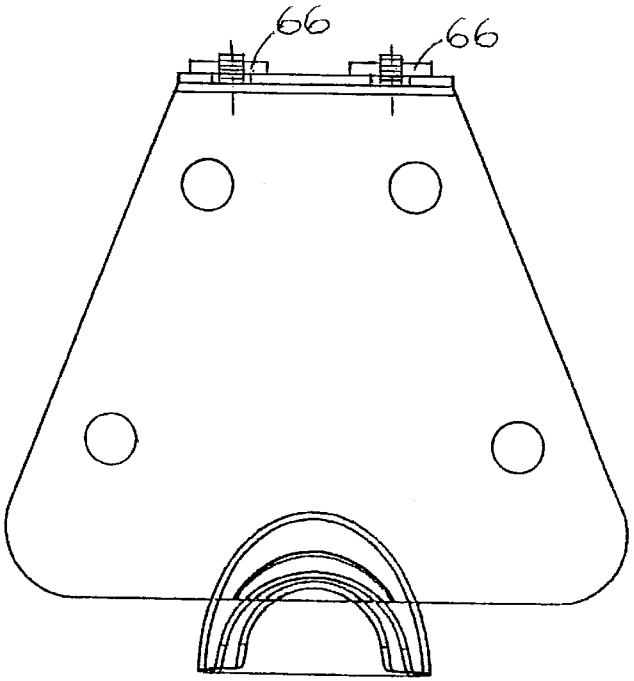
FIG. 9 is a top view of the urine deflector of FIG. 7.
Figure 8:
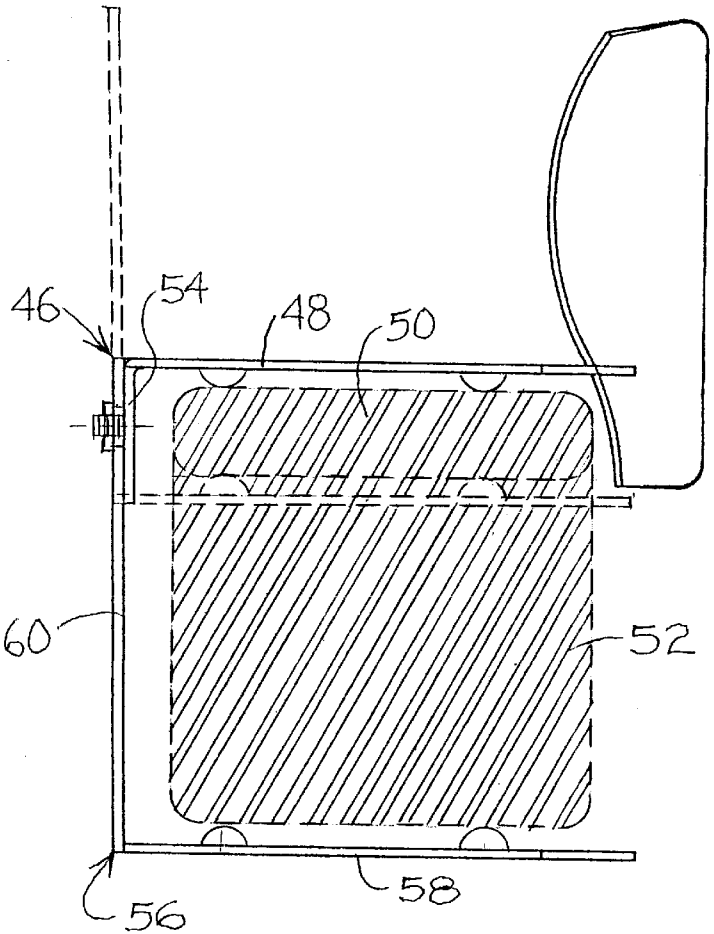
FIG. 8 is a side elevational view of the urine deflector of FIG. 7.
Figure 10:
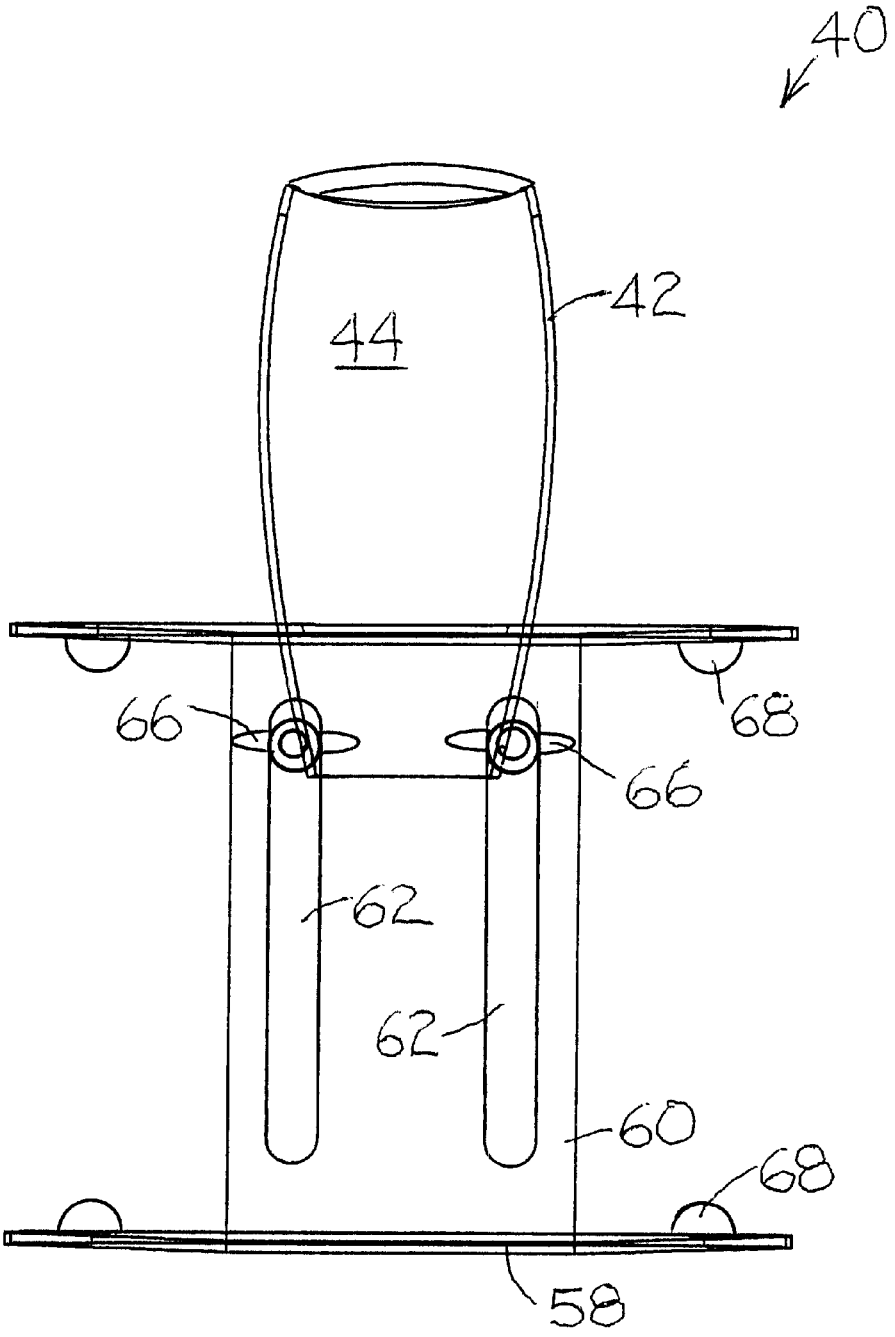
FIG. 10 is a front elevational view of the urine deflector of FIG. 7.
Figure 11:
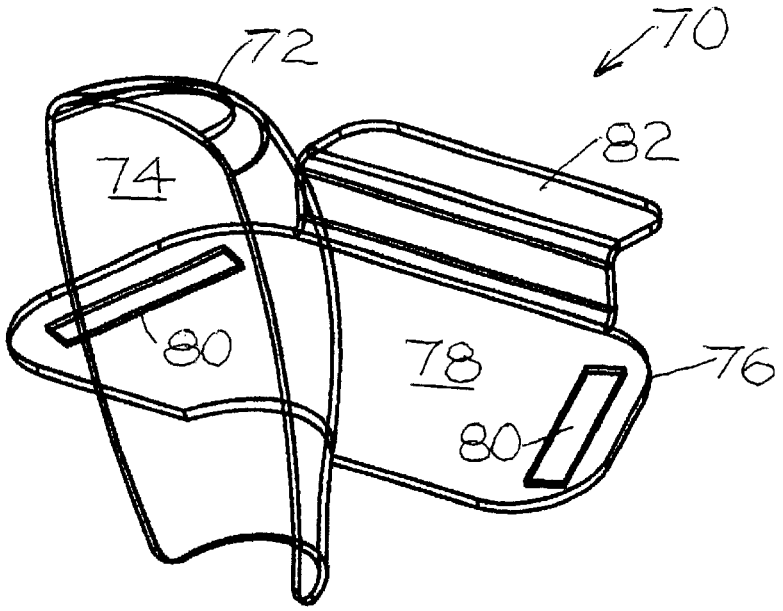
FIG. 11 is a perspective view of a fourth embodiment of a urine deflector according to the present invention.
Figure 12:
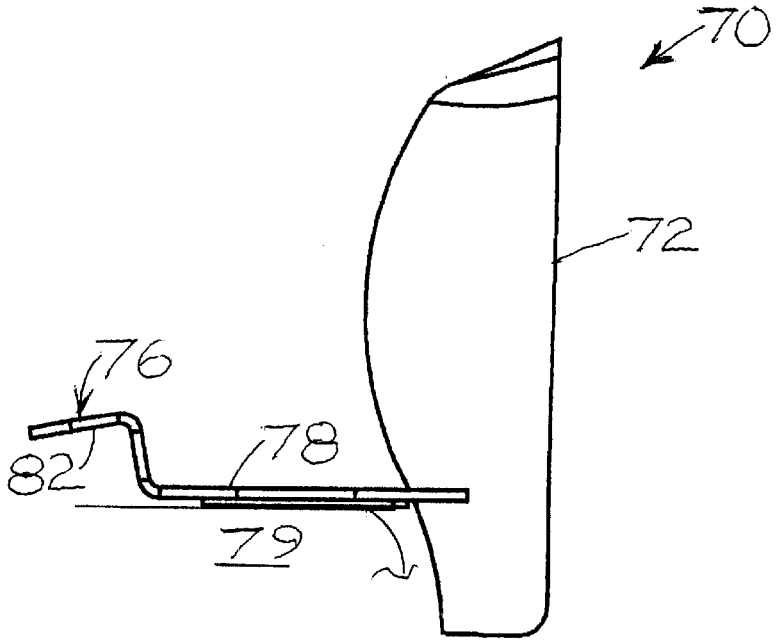
FIG. 12 is a side elevational view of the urine deflector of FIG. 11.
Figure 13:
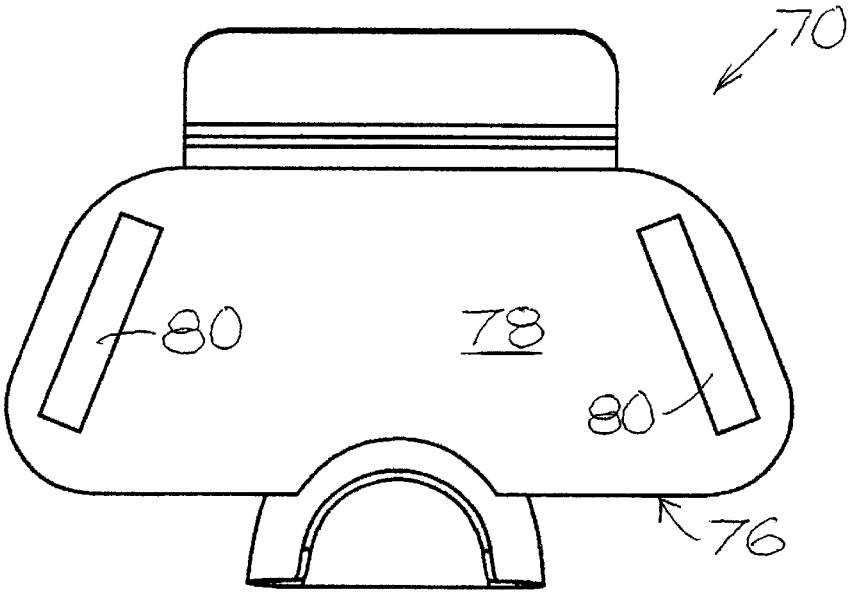
FIG. 13 is a bottom elevational view of the urine deflector of FIG. 11.
Figure 14:
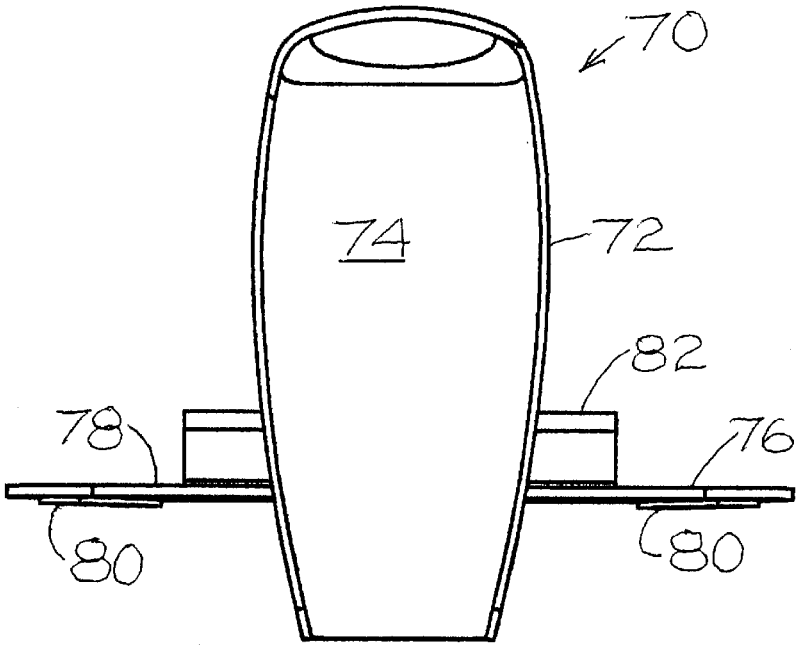
FIG. 14 is a front elevational view of the urine deflector of FIG. 11.

Referring now to FIGS. 5 and 6, an alternative embodiment of an adult urine deflector is generally shown at 30. This embodiment differs from the previous embodiment in that the clip 32 is interconnected with the deflection member 34 by a hinge 36. Tis embodiment allows the deflection member 34 to be pivoted with respect to the clip 32, as shown in dotted and solid lines in FIG. 5. This embodiment provides several advantages. First, the deflection member 34 may be pivoted upwardly prior to engaging the clip 32 on the toilet seat 12 thereby making installation easier. Secondly, if the patient or helper fails to remove the deflector 30 prior to removing the patient from the seat 12, the deflection member 34 may pivot so as to help prevent injury to the patient. The pivot 36 also allows the deflection member 34 to be positioned for optimal redirection of urine into the toilet bowl.

As will be clear to those of skill in the art, the deflector shown in FIGS. 1–6 may be altered in several ways without departing from the spirit or teaching of the present invention. For example, the splash cup may be altered so as to be taller, shorter, wider, or narrower, as necessary to accommodate particular toilet seats and to optimally redirect urine into the toilet bowl. One preferred alteration includes extending the lower edge of the deflection member 14 downwardly so that it covers the gap between the seat and toilet bowl even when the thick toilet seat is used. In fact, the lower edge may be extended downwardly even further to cover the upper rim of the bowl. This extension of the lower edge may be solid or flexible and may be long enough for use with a handicapped type toilet seat adaptor. Such an alteration is simplified in the embodiment of FIGS. 5 and 6 because the deflection member 34 pivots with respect to the clip. Therefore, extending the deflection member does not interfere with engagement of the clip 32 onto the seat 12. As another alteration, the lower lip 22 may be extended forwardly on either of the embodiments so as to more securely grip the seat 12.

Referring now to FIGS. 7–10, a third embodiment of a urine deflector according to the present invention will now be discussed. This version of the deflector 40 is similar to the prior embodiments in that a deflection member 42 with a concave inner deflection surface 44 is supported by a support member 46 designed to attach the deflector 40 to a toilet seat. The support member includes a top portion which is a generally planar body 48 designed to rest on the upper surface of a toilet seat. A standard thickness toilet seat 50 and an extra thick handicap toilet adaptor 52 are both shown in phantom outline in FIG. 8. An attachment flange 54 extends perpendicularly downwardly from the generally planar body 48. A lower portion 56 of the support member 46 interconnects with the attachment flange 54. The lower portion includes a second generally planar body 58 configured to pass under the lower surface of the toilet seat 50 or adapter 52. The lower portion 56 also has an attachment member 60 which extends perpendicularly upwardly from the second generally planar body 58 and interconnects with the attachment flange 54. As will be clear to those of skill in the art, the attachment flange 54 and the attachment member 60 may be interconnected in any of a number of ways. In the illustrated embodiment, the attachment member has a pair of elongated vertical slots 62 and the attachment flange 54 has a corresponding pair of fasteners 64 with wing nuts 66. By adjusting the position of the fasteners 64 in the elongated slots 62, the distance between the upper generally planar body 48 and the lower generally planar body 58 may be adjusted so that the deflector 40 is usable with a toilet seat of practically any thickness. Like with the previous embodiments, the deflector is used by sliding the support member 46 onto the toilet seat from the front edge. If the support member 46 is already adjusted to the proper size, the lower generally planar body 58 may be flexed enough in order to install the deflector onto the toilet seat. Alternatively, the wing nut 66 may be loosened so as to open the gap between the upper and lower planar bodies. The deflector is then installed on the seat, the upper and lower planar bodies brought together until they securely grip the front of the toilet seat, and then the wing nuts are tightened to hold the deflector in this position. To aid in securing the support member onto the toilet seat, plastic or rubber anti-slip grips 68 are provided on the upper side of the lower generally planar body 58 and on the underside of the upper generally planar body 48.

Referring again to FIG. 8, the support member 46 is shown adjusted to its widest position in solid lines and is shown in phantom line adjusted to its smallest position.

As will be clear to those of skill in the art, the embodiment of the present invention shown in FIGS. 7–10 may be constructed in a variety of sizes so as to suit various applications. In one model, the deflection member has a width of approximately 70 mm, and a height of approximately 150 mm. The leading edge of the deflection member 42 protrudes from the front edge of the upper generally planar body 48 by about 20 mm. In this model, the upper and lower generally planar bodies 48 and 58 have a front to back length of approximately 155 mm, a width at their widest point of 180 mm, and a width at their narrowest point of approximately 80 mm. They can be spread apart by a maximum distance of about 120 mm.

Referring now to FIGS. 11–14, a fourth embodiment of a urine deflector according to the present invention is generally shown at 70. Once again, this deflector 70 is similar to the previous embodiments in that it has a deflection member 72 with a concave inner deflection surface 74. The deflection member 72 is supported by a support member 76 which differs from in the previous embodiments. The support member 76 includes a generally planar support body 78 which, when disposed atop a toilet seat 79, holds the deflection member such that urine deflected by it passes through a hole in the toilet seat and such that the inner deflection surface 74 is directed towards a user seated on the toilet seat. Rather than the clip-like approach used in the previous embodiments, the attachment means for interconnecting the support member 76 with the toilet seat comprises a pair of adhesive strips 80 disposed on the underside of the generally planar support body 78. The adhesive strips 80 hold the generally planar member adjacent the upper surface of the toilet seat while the deflector 70 is in use. In order to remove the deflector from the toilet seat, a handle 82 is provided on the rear edge of the generally planar support body 78 so that the deflector may be easily gripped and raised upwardly to detach the adhesive strips 80. As will be clear to those of skill in the art, the adhesive strips may be reusable such that the deflector 70 may be attached and detached from one or more toilet seats or toilet seat adaptors. Also, the adhesive strips 80 may have material covering them to protect them when not in use. Also, the adhesive strips 80 may be replaceable as they wear out.

As will be clear to those of skill in the art, the various embodiments of the present invention may be made from a variety of materials. For example, they can be made from a plastic material that is reusable and easily cleaned. Alternatively, a metal version could be provided that can be heated for sterilization purposes. The deflector may also have a variety of surface treatments. The inner deflection surface may be textured so as to help resist splash back. For example, a pebbled surface may diffuse the stream of urine sufficiently to avoid significant splash back. Also, the deflector may have portions or all of it coated so as to improve grip. As yet another alternative, the deflector may have an antibacterial coating on all or part of it. The deflector may also be made from a disposable material. For example, a paperboard or other disposable material may be used to form the deflector or part thereof. The material may be designed to dissolve when fully submersed in a liquid such as a toilet bowl but to withstand a stream of urine during a single use. One approach would be to coat the inner deflection surface of the deflector with a wax or other water-resistant coating which will resist the stream of urine. However, the back surface of the deflection member and the remainder of the deflector may be uncoated such that when immersed, the entire deflector easily dissolves. Alternatively, the material may not dissolve in water but it may instead be thrown into a trash receptacle. As yet another alternative, the deflection member may be detachable from the support member with only the deflection member being disposable. The embodiment of the present invention illustrated in FIGS. 11–14 is particularly suitable to the use of disposable materials. The adhesive strips could then be single use strips with the entire deflector being thrown away or flushed after use. In use, a single deflector would be placed on the front of the toilet seat after the user is seated with the deflector being held in place by the adhesive strips. The single deflector may be dispensed from a dispenser on the wall or may be provided in individual sanitary containers for travel use.

Figure 15:
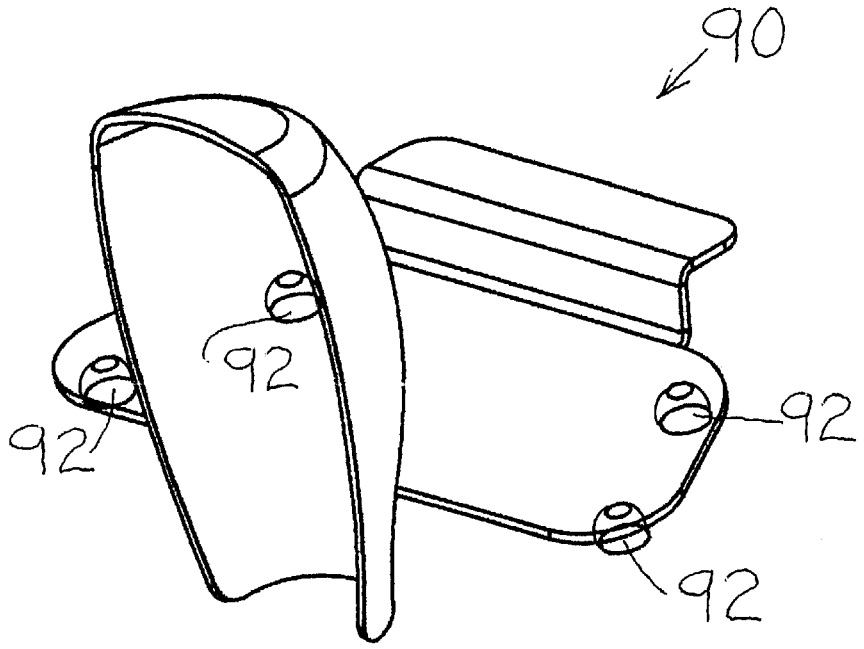
FIG. 15 is a perspective view of a fifth embodiment of a urine deflector according to the present invention.
Figure 16:
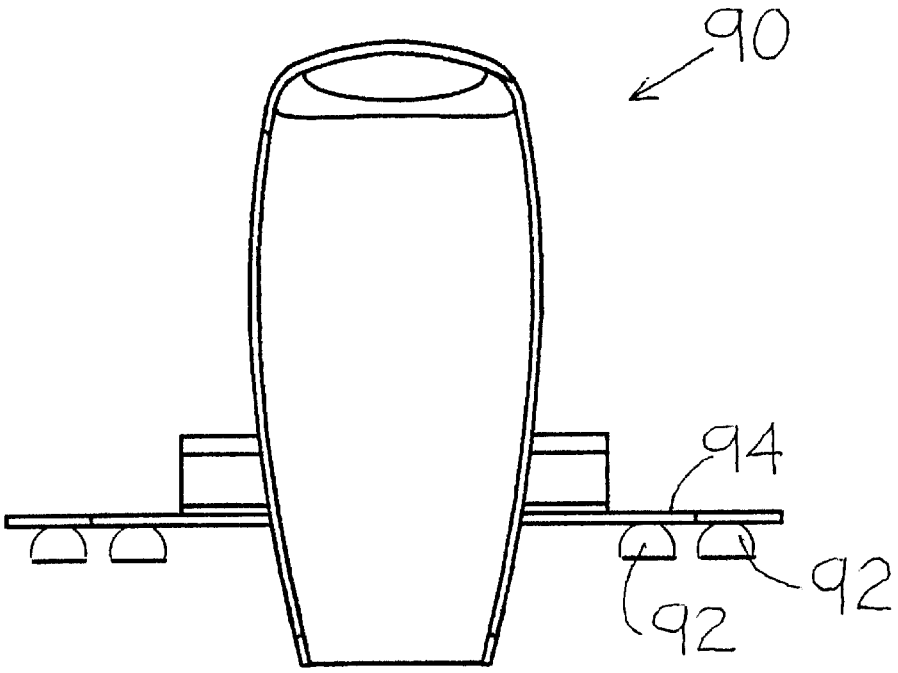
FIG. 16 is a front elevational view of the urine deflector of FIG. 15.

Referring now to FIGS. 15 and 16, a fifth embodiment of a deflector according to the present invention is generally shown at 90. This embodiment of the present invention differs from the embodiment of FIGS. 11–14 in that suction cups 92 are used to interconnect the generally planar support body 94 to the upper surface of the toilet seat. This embodiment may be easily reused multiple times due to the reusability of the suction cups.

As will be clear to those of skill in the art, other variations on the disclosed embodiments of the present invention may be made without departing from the teachings or scope of the present invention. It is the following claims, including all equivalents, which define of the scope of the invention.

We claim:

1. A urine deflector for detachable interconnection with a toilet seat having an upper surface configured to support a user and a hole defined through the seat, said deflector comprising:

a one piece stream deflection member for deflecting a stream of urine into a toilet bowl, said deflection member having an upper edge and a lower edge and a concave deflection surface extending therebetween, the deflection surface being horizontally and vertically concave, and smoothly curved between the upper and lower edges without any discontinuity;

a support member extending from said deflection member, said member having a generally planar body configured to be supported on the upper surface of the seat, said body supporting said deflection member such that when said body is disposed on the upper surface said deflection member projects through the hole in the seat with the lower edge disposed below the surface of the seat and the concave deflection surface faces a user seated on the seat;

said support member further comprising attachment means for releasably retaining said generally planar body in engagement with the upper surface of the seat.

2. A urine deflector according to claim 1, wherein the lower edge of said deflection member comprises a downwardly extending skirt which extends below the generally planar body when the planar body is supported on the upper surface of the seat.

3. A deflector according to claim 2, wherein said downwardly extending skirt extends below a lower surface of the toilet seat when the generally planar body is supported on the upper surface of the seat.

4. A urine deflector according to claim 1, wherein said attachment means comprises adhesive strips disposed on the underside of the generally planar body.

5. A deflector according to claim 1, wherein the deflection member is formed of a disposable paper material.

6. A deflector according to claim 5, wherein the material dissolves when fully immersed in water.

7. A deflector according to claim 6, wherein the disposable paper material is coated on the deflection surface and uncoated on other surfaces.

8. A urine deflector for detachable interconnection with a toilet seat having an upper surface configured to support a user and a hole defined through the seat, said deflector comprising:

a stream deflection member for deflecting a stream of urine into a toilet bowl, said deflection member having an upper edge and a lower edge and a concave deflection surface extending therebetween, the deflection surface being horizontally and vertically concave, and smoothly curved between the upper and lower edges without any discontinuity;

a support member having a generally planar body configured to be supported on the upper surface of the seat, said generally planar body having a generally planar lower surface with no projections extending therefrom, said body supporting said deflection member such that when said body is disposed on the upper surface said deflection member projects through the hole in the seat with the lower edge disposed below the surface of the seat and the concave deflection surface faces a user seated on the seat;

said support member further comprising attachment means for releasably retaining said generally planar body in engagement with the upper surface of the seat.

9. A urine deflector according to claim 8, wherein the lower edge of said deflection member comprises a downwardly extending skirt which extends below the generally planar body when the planar body is supported on the upper surface of the seat.

10. A deflector according to claim 9, wherein said downwardly extending skirt extends below a lower surface of the toilet seat when the generally planar body is supported on the upper surface of the seat.

11. A urine deflector according to claim 8, wherein said attachment means comprises adhesive strips disposed on the underside of the generally planar body.

12. A deflector according to claim 8, wherein the deflector is formed of a disposable paper material.

13. A deflector according to claim 12, wherein the material dissolves when fully immersed in water.

14. A deflector according to claim 13, wherein the disposable paper material is coated on the deflection surface and uncoated on other surfaces.

15. A urine deflector for detachable interconnection with a toilet seat having an upper surface configured to support a user and a hole defined through the seat, said deflector comprising:

a stream deflection member for deflecting a stream of urine into a toilet bowl, said deflection member having an upper edge and a lower edge and a concave deflection surface extending therebetween, the deflection surface being horizontally and vertically concave, and smoothly curved between the upper and lower edges without any discontinuity;

a support member having a generally planar body configured to be supported on the upper surface of the seat, said body supporting said deflection member such that when said body is disposed on the upper surface said deflection member projects through the hole in the seat with the lower edge disposed below the surface of the scat and the concave deflection surface faces a user seated on the seat;

said support member further comprising attachment means for releasably retaining said generally planar body in engagement with the upper surface of the seat; and wherein said deflector is formed of a disposable paper material that dissolves when fully immersed in water.

16. A urine deflector according to claim 15, wherein the lower edge of said deflection member comprises a downwardly extending skirt which extends below the generally planar body when the planar body is supported on the upper surface of the seat.

17. A deflector according to claim 16, wherein said downwardly extending skirt extends below a lower surface of the toilet seat when the generally planar body is supported on the upper surface of the seat.

18. A urine deflector according to claim 15, wherein said attachment means comprises adhesive strips disposed on the underside of the generally planar body.

19. A deflector according to claim 15, wherein the disposable paper material is coated on the deflection surface and uncoated on other surfaces.

* * * * *